US008037787B2

(12) United States Patent
Lin

(10) Patent No.: US 8,037,787 B2
(45) Date of Patent: Oct. 18, 2011

(54) MULTI-FUNCTION TOOL HAVING RETRACTABLE JAWS

(76) Inventor: Jieqing Lin, Yangjiang (CN)

( * ) Notice: Subject to any disclaimer, the term of this patent is extended or adjusted under 35 U.S.C. 154(b) by 153 days.

(21) Appl. No.: 12/468,876

(22) Filed: May 20, 2009

(65) Prior Publication Data

US 2010/0050827 A1 Mar. 4, 2010

(30) Foreign Application Priority Data

Sep. 2, 2008 (CN) ..... 2008 2 0135194 U

(51) Int. Cl.
*B25B 7/22* (2006.01)

(52) U.S. Cl. ..... 81/427.5; 7/128

(58) Field of Classification Search ..... 81/427.5, 81/415–417, 177.4, 177.6, 489, 490; 7/118, 7/125–131, 135, 167, 168; 30/255
See application file for complete search history.

(56) References Cited

U.S. PATENT DOCUMENTS

| | | | | |
|---|---|---|---|---|
| 2,126,699 | A * | 8/1938 | Florian | 30/161 |
| 5,029,355 | A * | 7/1991 | Thai | 7/118 |
| 5,564,318 | A * | 10/1996 | Pail | 81/427.5 |
| 5,829,329 | A | 11/1998 | Frazer | |
| 6,185,771 | B1 * | 2/2001 | Trusty, Sr. | 7/128 |
| 6,711,820 | B2 * | 3/2004 | Chen | 30/122 |

* cited by examiner

*Primary Examiner* — David B Thomas
(74) *Attorney, Agent, or Firm* — Muncy, Geissler, Olds & Lowe, PLLC

(57) ABSTRACT

A multi-function tool is formed in a compact structure at a smaller size and can bear greater force and has a handle capable of holding more other tools. It has a jaw head consisting of a first jaw, a second jaw, a first handle and a second handle that are hinged on the same axle and turnable thereon. By adopting one axle, the compact structure can be realized. The first handle has lateral sides and a rear end to hold other tools such as knives, scissors, screwdrivers, a can opener and the like.

6 Claims, 8 Drawing Sheets

MULTI-FUNCTION TOOL HAVING RETRACTABLE JAWS

FIELD OF THE INVENTION

The present invention relates to a multi-functional tool equipped with retractable jaws of pliers and scissors.

BACKGROUND OF THE INVENTION

U.S. Pat. No. 5,829,329 assigned to Frazer Spencer discloses a hand tool with retractable jaws that overcomes the problem of conventional techniques of difficult to open jaw head quickly and simply. It improves in some degrees the practicality of the conventional pliers and enables the pliers to be used more conveniently and flexibly. It adopts a structure which has two jaws hinged on a first pivot, and a second pivot to couple the jaw head and a first handle. The two pivots make the size of the jaw head larger, hence the handle cannot accommodate more tools. When the jaw head is in use, the first pivot receives force, the second handle which drives closing of the front end of the jaw head turns about the second pivot. The force is applied eccentrically. Hence the jaw head cannot bear a greater force. Applicability of the tool is limited.

To provide a tool with a compact structure and smaller size, and capable of bearing greater force and holding more other tools in the handle is a requirement still pending to be fulfilled.

SUMMARY OF THE INVENTION

Therefore, the primary object of the present invention is to provide a multi-function tool equipped with retractable jaws. It includes a jaw head consisting of a first jaw and a second jaw, and a first handle and a second handle that are hinged on the same axle. As only one axle is employed, the structure is compact. The lateral side and rear end of the first handle have more rooms to hold other tools, such as small knives, scissors, screwdrivers, can opener and the like.

In one aspect, the first and second handles form a chamber between them to hold the jaw head. The jaw head can be extended and turned about the axle to be wedged in the chamber in a retracted manner. A latch mechanism is provided to latch the jaw head in the retracted condition, and also latch the first jaw in the extended condition to keep the longitudinal direction of the first jaw. The first jaw and second jaw are interposed by a spring. During the extended condition, the spring pushes the second jaw to turn about the axle backwards from the first jaw so that the front ends of the first and second jaws are extended. In the extended condition, the second handle and second jaw are coupled on an inner side. The second handle can be depressed by user's hand to drive the second jaw to turn about the axle towards the first jaw to close the front ends.

In another aspect, the jaw head and the first handle are interposed by an annular spring. In the retracted condition, the annular spring is compressed. When using the jaw head is required, the latch mechanism is released. The annular spring provides an elastic force to automatically extend the jaw head from the chamber outwards and the first jaw can be latched by the latch mechanism to form the extended condition. To retract the jaw head, release the latch mechanism, push the jaw head manually to compress the annular spring and turn towards the first handle; push the first jaw into the chamber to be latched by the latch mechanism; continuously push the second jaw to compress the spring between the first and second jaws until the second jaw also is latched by the latch mechanism; then the retracted condition is formed.

Compared with the conventional hand tools, the invention provides a smaller size, more compact structure, and can hold more other tools. The jaw head can be unfolded single-handed. Utilization is easier. It also can be used as the standard pliers and bear greater force.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
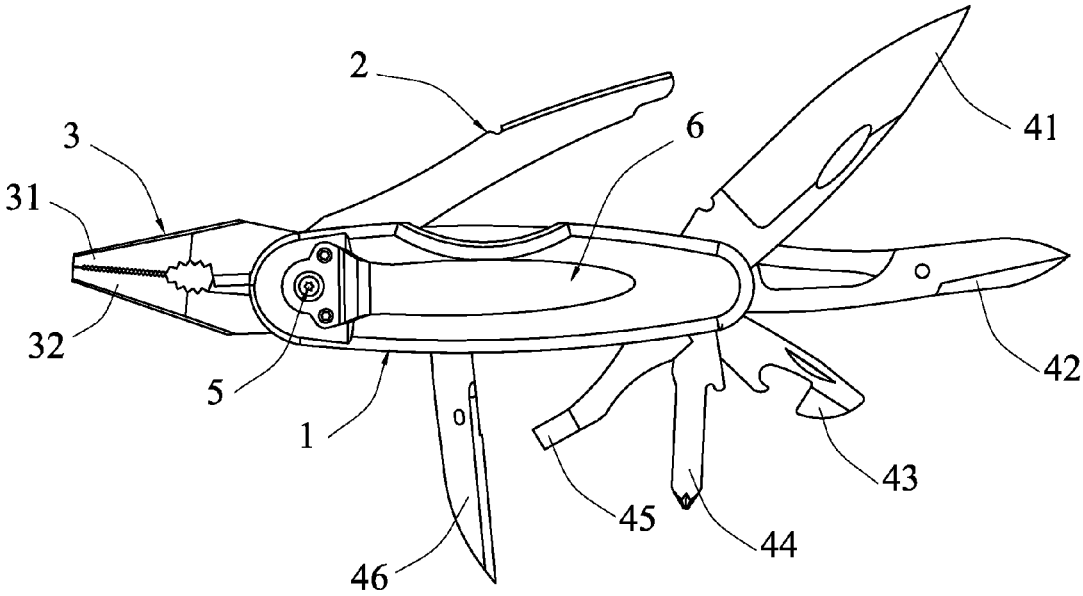
FIG. 1 is a schematic view of the invention with all the tools extended.
Figure 2:
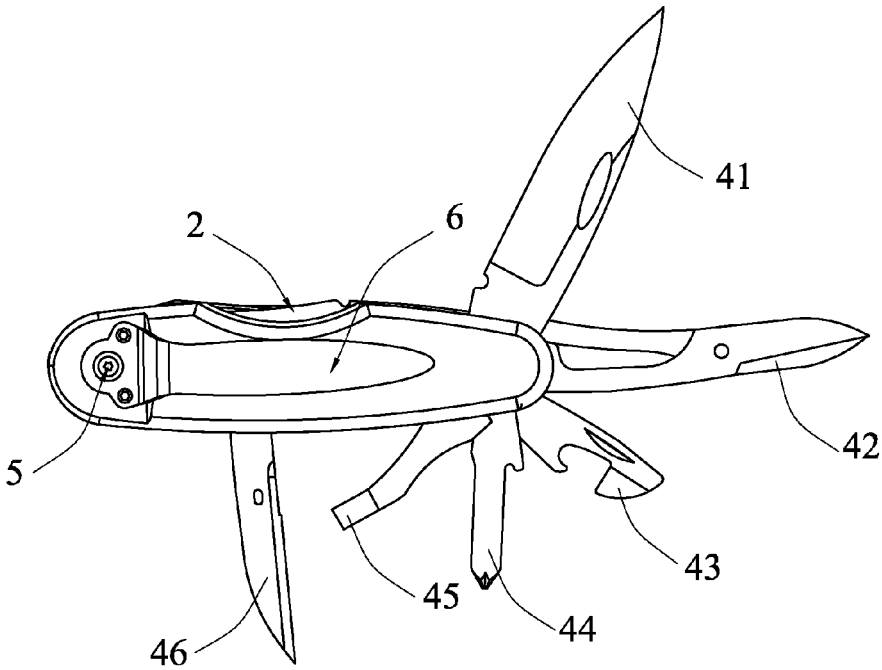
FIG. 2 is a schematic view of the invention with the jaw head extending other tools.
Figure 3:
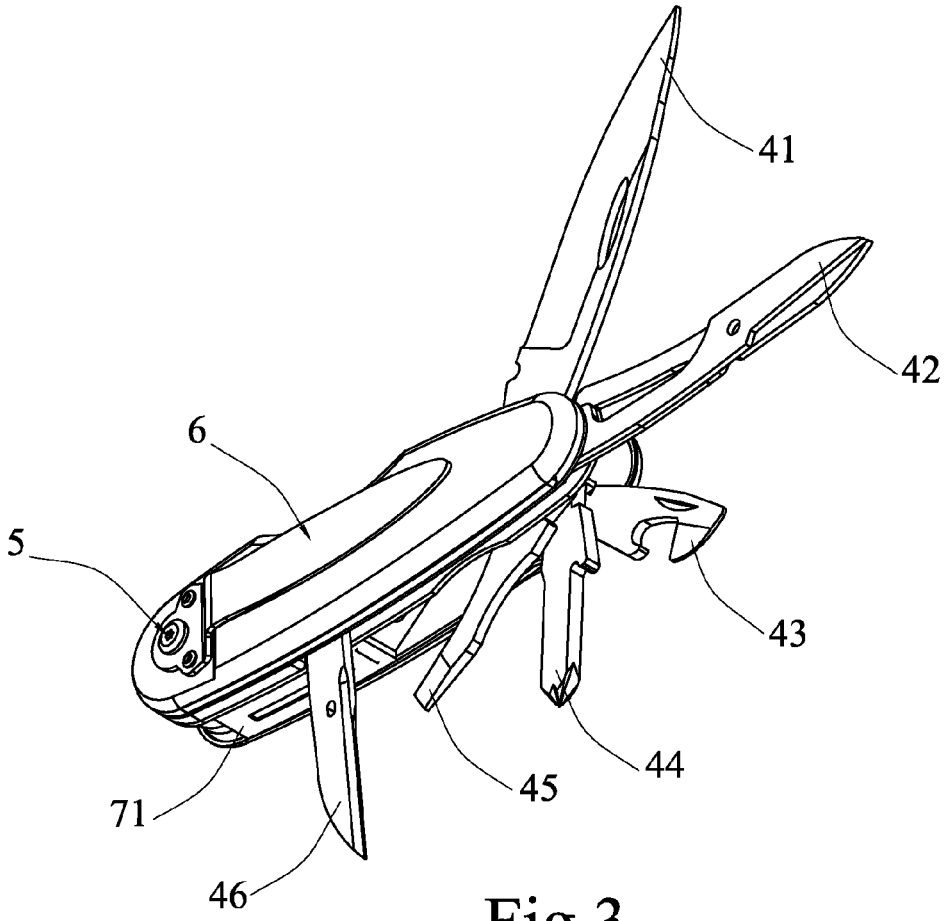
FIG. 3 is a perspective view according to FIG. 2.
Figure 4:
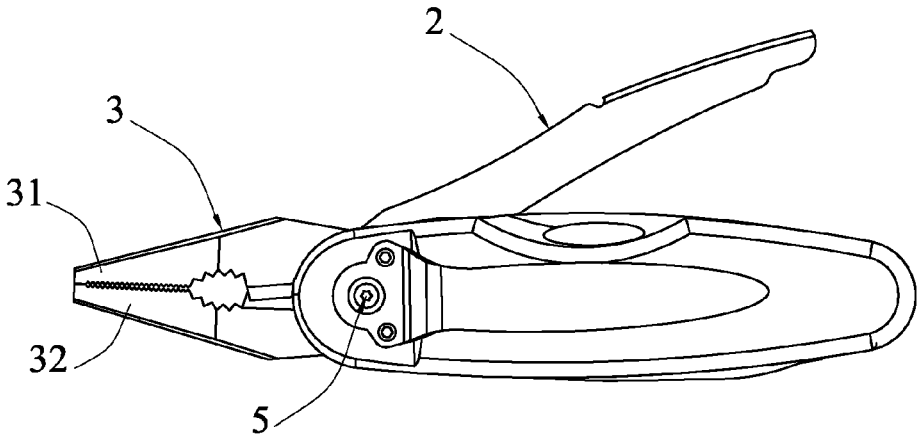
FIG. 4 is a schematic view of the invention with the jaw head extended and other tools retracted.
Figure 5:
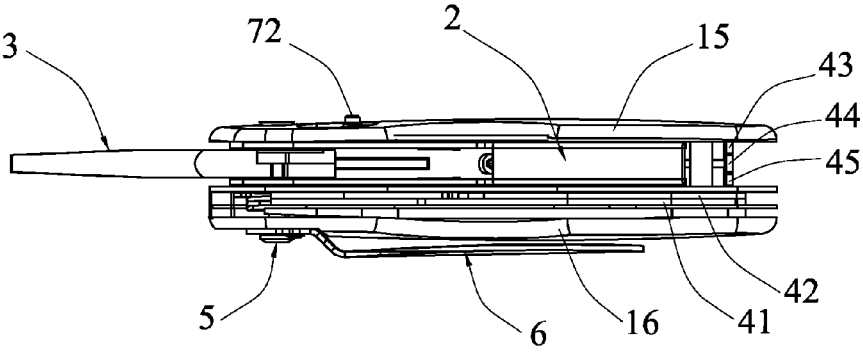
FIG. 5 is a top view according to FIG. 4.
Figure 6:
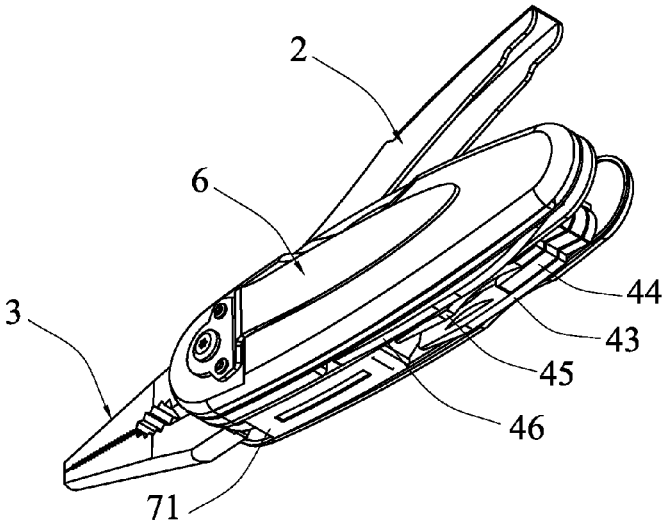
FIG. 6 is a perspective view according to FIG. 4.
Figure 7:
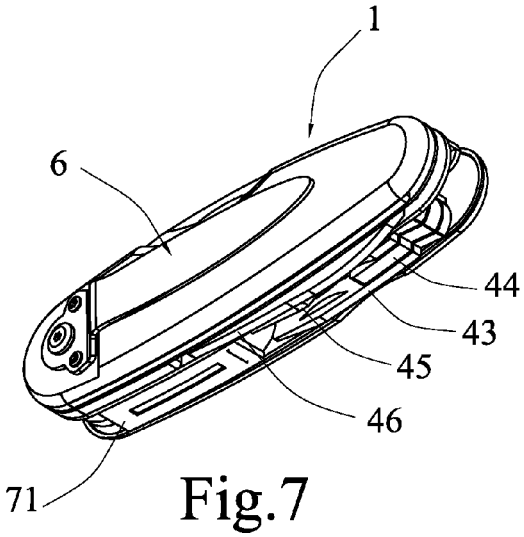
FIG. 7 is a perspective view of the invention with all the tools retracted.
Figure 8:
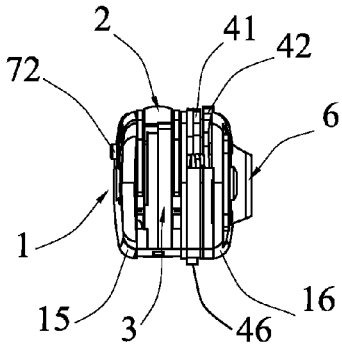
FIG. 8 is a side view according to FIG. 7.

Please refer to FIG. 1, the multi-function tool according to the invention includes a first handle 1 which has a front end hinged an axle 5 and a jaw head 3 and a second handle 2. The jaw head 3 and the second handle 2 can turn about the axle 5 to be retracted in the first handle 1 as shown in FIGS. 2 and 3. The first handle 1 has a rear end coupling with other tools such as a can opener 43, a Phillips head screwdriver 44 and a flat-head screwdriver 45, and small knives 41 and 46, scissors 42 and the like on lateral sides. These tools can be turned and retracted in the first handle 1 as shown in FIGS. 4, 5 and 6. Referring to FIGS. 7 and 8, when all the tools are retracted, the entire size of the multi-function tool is smaller and can be clipped on user's clothes or waist band through a clip 6. When the jaw head 3 is in the retracted condition, referring to FIGS. 3 and 7, a first jaw 31 is latched by a latch plate 71. When the jaw head 3 is in an extended condition, referring to FIG. 6, the first jaw 31 also is latched by the latch plate 71. On the first handle 1, there is a release lever 72 located on the other side opposite to the clip 6. By moving the release lever 72, the first jaw 31 can be unlatched from the latch plate 71.

Figure 9:
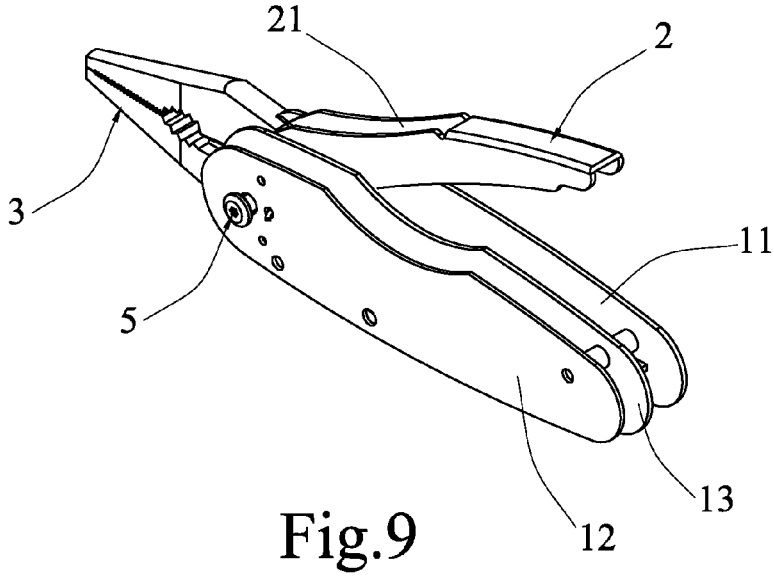
FIG. 9 is a perspective view according to FIG. 4 with the casing and other tools removed.
Figure 10:
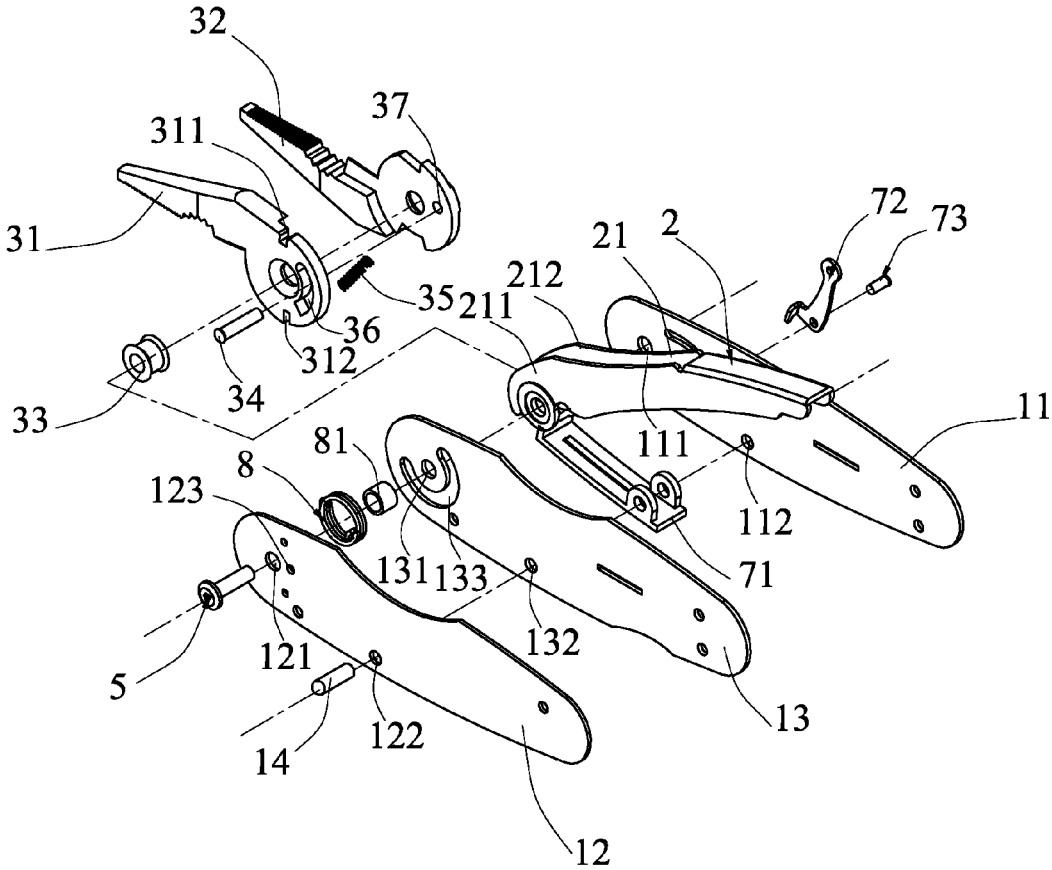
FIG. 10 is a schematic view according to FIG. 9 in an assembly condition.
Figure 11:
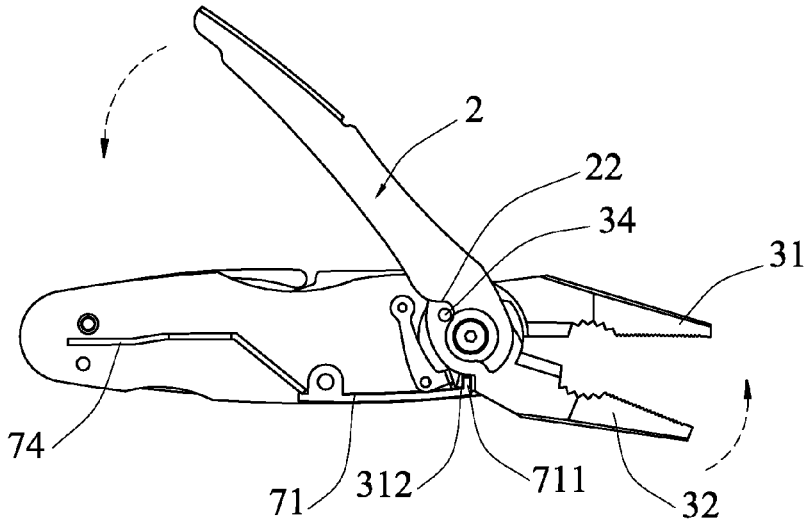
FIG. 11 is a schematic view according to FIG. 4 in a use condition, with the first side plate removed.

There are ornamental covers 15 and 16 on outer sides of the first handle 1 that can be removed. Other tools also can be removed as shown in FIGS. 9 and 10 for the detailed structure in such a circumstance. The first handle 1 includes a first side plate 11, a middle plate 13 and a second side plate 12. The jaw head 3 and the second handle 2 are hinged through the axle 5 between the first side plate 11 and the middle plate 13. The latch plate 71 is hinged through a pin 14 between the first side plate 11 and the middle plate 13 and turnable. The release lever 72 is mounted on an outer side of the first side plate 11 through another pin 73 and turnable. The latch plate 71 has a front end with a lug 711 located thereon jutting upwards. The lug 711 can be latched in a latch notch 312 formed on a lower side of the first jaw 31 when the jaw head 3 is in the extended condition. When the jaw head 3 is in the retracted condition, the lug 711 can be latched in another latch notch 311 formed on an upper side of the first jaw 31. The latch plate 71 has a rear end compressed by an elastic reed 74 so that the front end of the latch plate 71 turns about the pin 14 and tilts upwards to latch the first jaw 31 as shown in FIG. 11.

The jaw head 3 includes the first jaw 31 and a second jaw 32 that are through a bearing 33 hinged on the axle 5 and turnable. The first jaw 31 has a distal end with one side holding the axle 5 as the axis of an arched slot 36 which holds a spring 35. The second jaw 32 can be turned about the axle 5 away from the first jaw 31 through the spring 35. The second jaw 32 has another distal end with a jutting strut 34 located on one side. The strut 34 runs through the arched slot 36 to compress one end of the spring 35 to slide in the arched slot 36 so that the front end of the jaw head 3 is extended.

Figure 14:
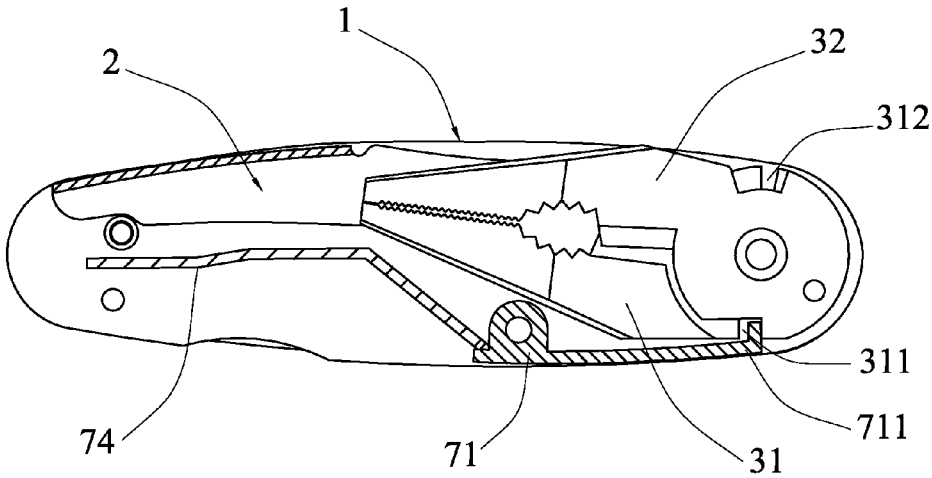
FIG. 14 is a schematic view of the internal structure according to FIG. 4 with the jaw head retracted.
Figure 15:
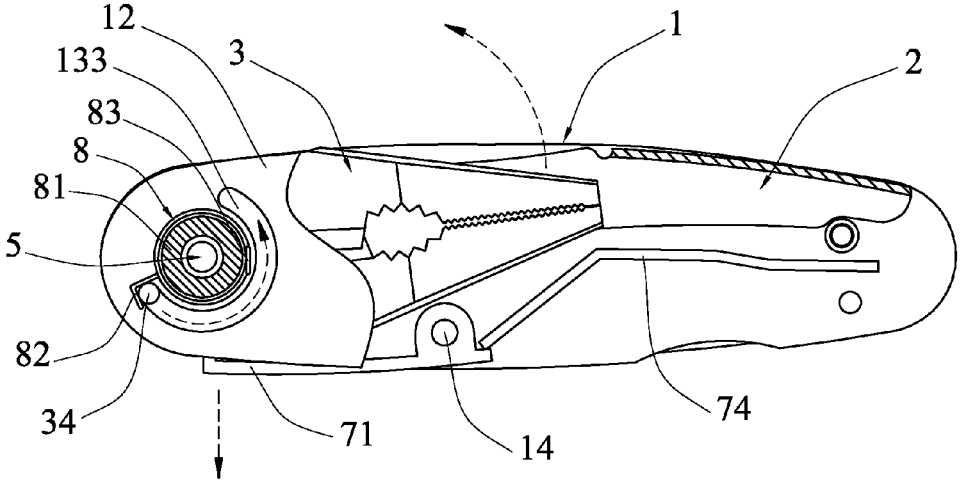
FIG. 15 is another side view according to FIG. 14.

The second handle 2 has a slot 21 to allow the jaw head 3 to pass through. When the first handle 1 is in the retracted condition, the jaw head 3 runs through the slot 21 and is wedged and held in a chamber between the first and second handles 1 and 2 as shown in FIGS. 14 and 15. The slot 21 is extended to the front end of the second handle 2 and forms in a bifurcated structure. The rear end of the jaw head 3 is wedged in the bifurcated structure. There is a recess 22 below the bifurcated structure to move the strut 34 so that the second jaw 32 can be turned against the first jaw 31 as shown in FIG. 11.

Figure 19:
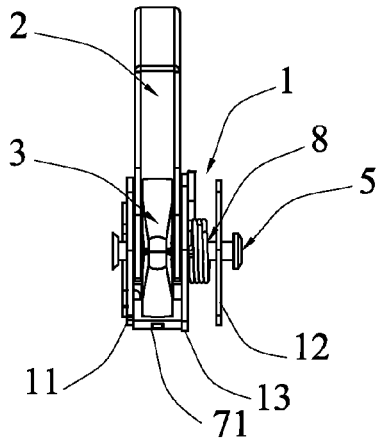
FIG. 19 is a side view according to FIG. 4.
Figure 20:
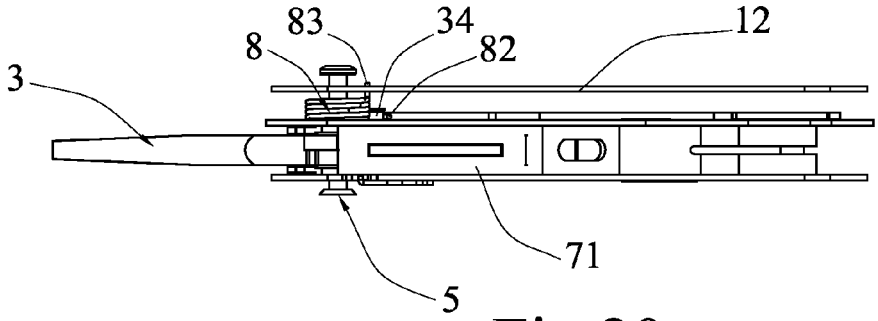
FIG. 20 is a bottom view according to FIG. 4.

There is an annular spring 8 coupled on an axle sleeve 81, and installed between the middle plate 13 and the second side plate 12. The axle 5 is held in the axle sleeve 81. The middle plate 13 has a front end formed with a curved opening 133 centering on the axle 5. The strut 34 runs through the curved opening 133 and couples with the annular spring 8. Also referring to FIG. 15, the annular spring 8 has a first end formed a first hook 82 to latch on the strut 34 and a second end formed a second hook 83 to latch in an aperture 123 formed on the second side plate 12. When the jaw head 3 is turned about the axle against the first handle 1 from the extended condition to the retracted condition, the strut 34 compresses the annular spring 8. When the latch mechanism is released, the annular spring 8 pushes the jaw head from the retracted condition to the extended condition. FIGS. 19 and 20 show the structural location of the annular spring 8.

The axle 5 runs through, in this order, an axle hole 121 formed on the second side plate 12, annular spring 8, axle sleeve 81, another axle hole 131 formed on the middle plate 13, jaw head 3, bearing 33, second handle 2 and yet another axle hole 111 formed on the first side plate 11 to couple with the front end of the first handle 1 to become an integrated body. The pin 14 runs through a pin hole 122 formed on the second side plate 12, another pin hole 132 formed on the middle plate 13, latch plate 71 and another yet another pin hole 112 formed on the first side plate 11 to couple with the middle portion of the first handle 1 to become an another integrated body. The other tools such as knife 41, can opener 42, scissors 43 and the like are coupled on the rear end of the first handle 1.

Figure 12:
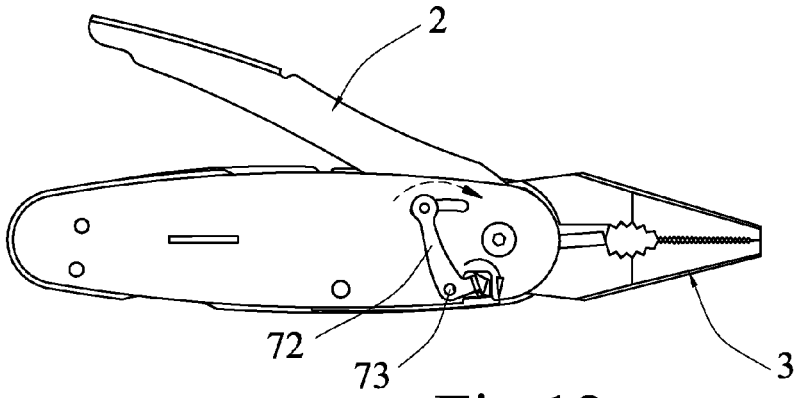
FIG. 12 is a schematic view according to FIG. 4 in a use condition, with the jaw head retracted.
Figure 13:
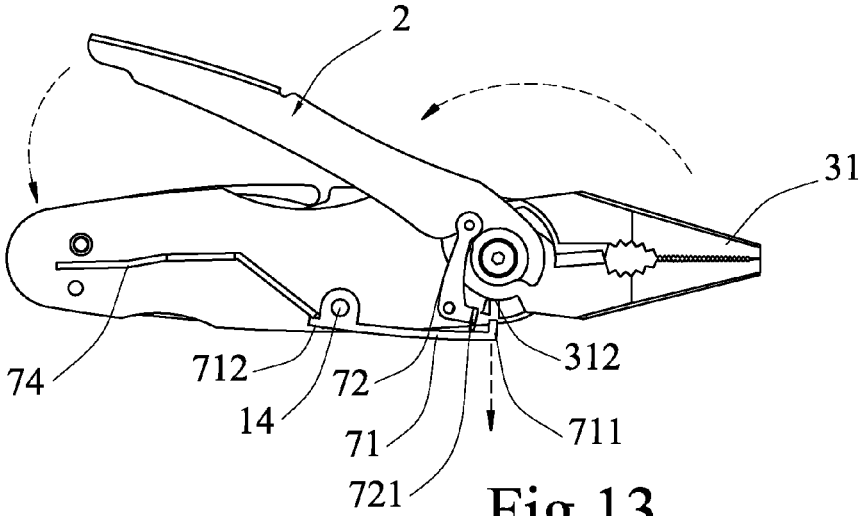
FIG. 13 is a schematic view according to FIG. 12 in a use condition, with the first side plate removed.

To retract the jaw head 3 in the first handle 1, referring to FIGS. 11, 12 and 13, first, push the second handle 2, the recess 22 depresses the strut 34 to turn the second jaw 32 towards the first jaw 31 so that the front end of the jaw head 3 is closed as shown by the arrow in FIG. 11. Next, push the release lever 72 to turn about the pin 73 as shown in FIG. 12. The L-shaped release lever 72 has a lower end 721 pushing the latch plate 71 to turn about the pin 14 so that the lug 711 escapes from the latch notch 312, and latching of the latch plate 71 on the first jaw 31 is released. Turn manually the jaw head 3 and the second handle 2 to retract them in the first handle 1 as shown in FIG. 13. Meanwhile, the strut 34 pushes one end of the annular spring 8 to form compression thereof.

When the jaw head 3 is fully retracted in the first handle 1, release the release lever 72, the latch plate 71 is pushed by the compressed lower end of the elastic reed 74 to tilt upwards. The lug 711 latches on the latch notch 311, and the retracted condition is latched as shown in FIG. 14. When extending the jaw head 3 is required, push the release lever 72 to move the lug 711 away from the latch notch 311. As the second hook 83 of the annular spring 8 latched in the aperture 123 of the second side plate 12 serves as an anchor end, the jaw head 3 is in the retracted condition and the spring is compressed. Once the latch condition of the first jaw 31 is released, the first hook 82 of the annular spring 8 pushes the strut 34 to slide in the curved opening 133, thus the jaw head 3 is automatically driven and extended as shown in FIG. 15.

Figure 16:
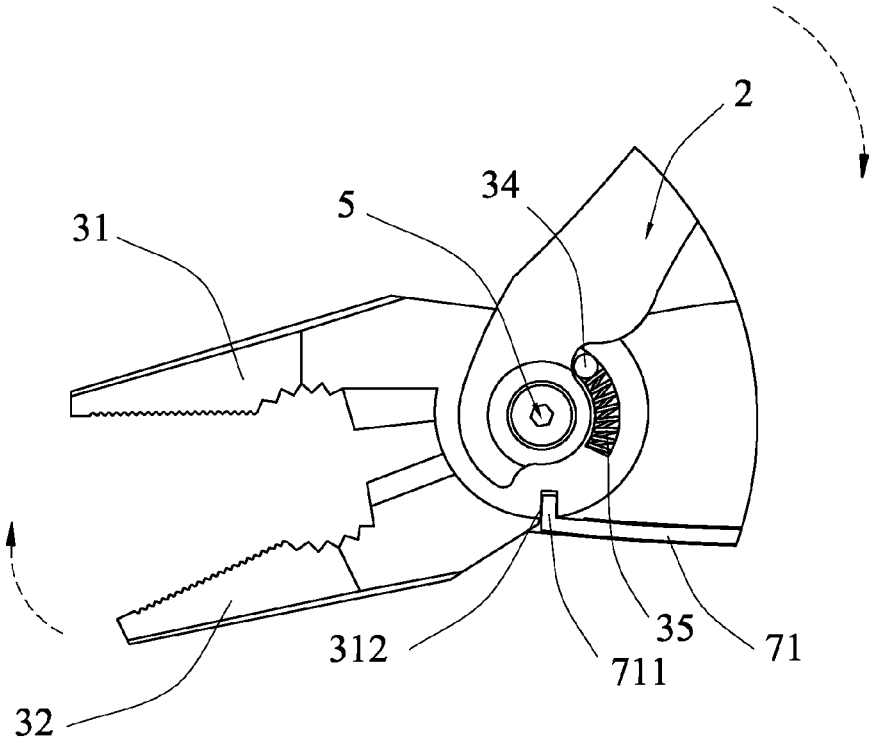
FIG. 16 is a schematic view of the internal structure with the jaw head in an extended condition.
Figure 17:
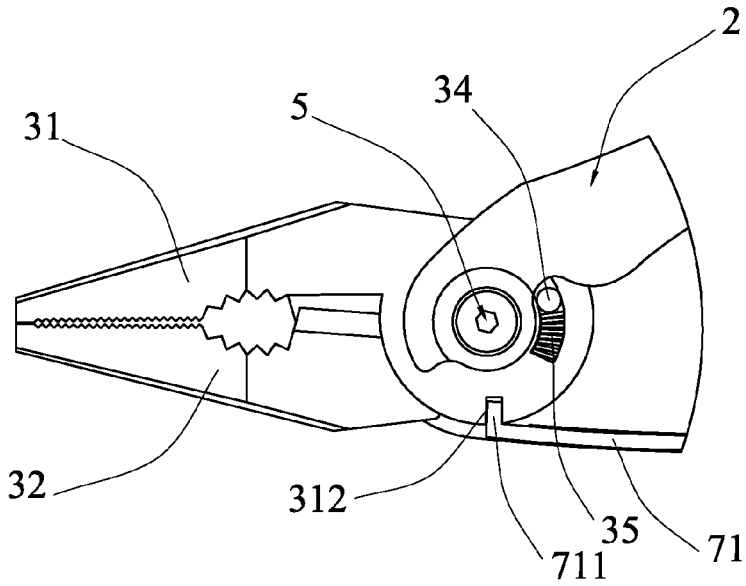
FIG. 17 is a schematic view of the internal structure with the jaw head in a closed condition.
Figure 18:
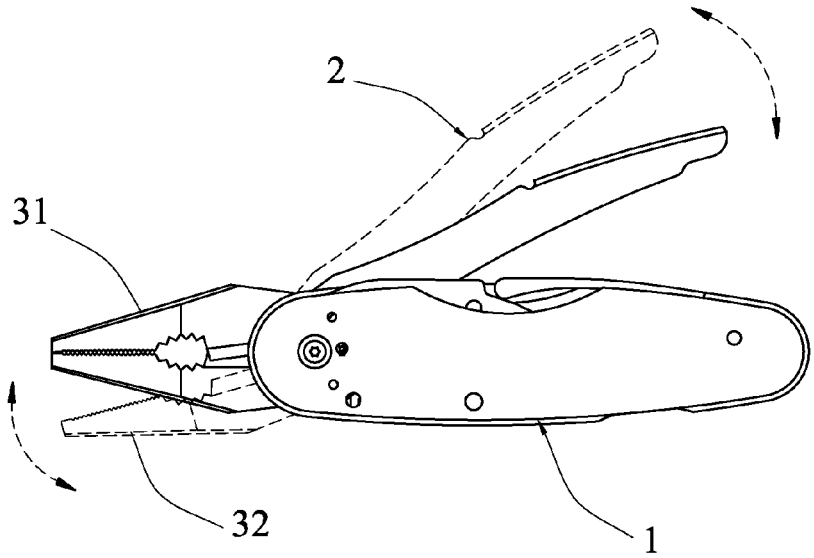
FIG. 18 is a schematic view of the jaw head in a use condition.

When the jaw head 3 is extended as previously discussed, the lug 711 latches on the latch notch 312, the first jaw 31 is latched, and the jaw head 3 is pushed by the spring 35 so that the front end thereof is extended as shown in FIG. 16. When the pliers are in use, depress the second handle 2 to push the strut 34 and compress the spring 35, the second jaw 32 turns towards the first jaw 31, then the front end of the jaw head 3 is closed from the extended condition as shown in FIG. 17. When the second handle 2 is released, the spring 35 pushes the strut 34 to drive the second jaw 32 to turn backwards against the first jaw 31. Then the front end of the jaw head 3 is automatically extended from the closed condition as shown in FIG. 16, and it can be used in a condition as shown in FIG. 18.

As a conclusion, the invention provides a tool with a compact structure at a smaller size, and can bear greater force, and the handle also can hold more other tools.

What is claimed is:

1. A multi-function tool having retractable jaws, comprising:

an axle;

a jaw head including a first jaw, a second jaw, a front end and a rear end, the rear end being hinged on the axle, the second jaw being turnable about the axle towards the first jaw to close the front end from an extended condition;

a first handle having a front end and a rear end, the jaw head and the axle being hinged on the front end of the first handle, the jaw head being turnable about the axle to be held in the first handle in a retracted condition and in the extended condition;

a latch mechanism to latch the jaw head in the first handle in the retracted condition, the latch mechanism being releasable manually to turn the jaw head from the retracted condition to the extended condition; the latch mechanism latching the first jaw in the extended condition such that the second jaw is turnable about the axle towards or backwards from the first jaw;

a second handle coupling with the first handle through the axle; the second handle and the second jaw being coupled when the jaw head is in the extended condition, the second handle being turnable about the axle against the first handle to push the second jaw to turn about the axle towards the first jaw so that the front end of the jaw head is closed from the extended condition;

a chamber formed between the first handle and the second handle to hold the jaw head; and at least one selected tool located on one side or the rear end of the first handle:

wherein the second handle has a slot allowing the jaw head to pass through and wedge in the chamber between the first handle and the second handle when the jaw head is held in the first handle in the retracted condition.

2. The multi-function tool of claim 1 further including:

a spring to push the second jaw to turn about the axle backwards from the first jaw so that the front end of the jaw head is extended; and an arched slot formed on one side of a distal end of the first jaw to hold the spring and centered on the axle, and a strut jutting from one side of a distal end of the second jaw to run through the arched slot to butt one end of the spring to slide in the arched slot;

wherein the second handle pushes the strut to turn the second jaw towards the first jaw so that when the front end of the jaw head is closed from the extended condition, the strut compresses the spring; when the second handle is released, the spring pushes the strut to turn the second jaw backwards from the first jaw so that the front end of the jaw head is automatically extended from the closed condition.

3. The multi-function tool of claim 2 further including:

an annular spring which is located on one side of the jaw head and coupled on the axle and has two ends respectively formed hooks to latch the jutting strut and the first handle; when the jaw head is turned about the axle against the first handle from the extended condition to the retracted condition, the strut compresses the annular spring; when the latch mechanism is released, the annular spring automatically pushes the jaw head from the retracted condition to the extended condition.

4. The multi-function tool of claim 3, wherein the first handle at least has a first side plate, a middle plate and a second side plate, the jaw head, the second handle and the latch mechanism being installed between the first side plate and the middle plate, the annular spring being installed between the middle plate and the second side plate, the middle plate having a curved opening formed on a front end thereof centered on the axle, the jutting strut running through the curved opening to couple with the annular spring.

5. The multi-function tool of claim 4, wherein the curved opening is formed at a length at least two times of the arched slot.

6. The multi-function tool of claim 1, wherein the slot is extended to the front end of the second handle to form a bifurcated structure to be wedged in by the rear end of the jaw head, the bifurcated structure having a recess on a lower side to push the strut to turn the second jaw against the first jaw.

* * * * *